US006331004B1

(12) United States Patent
Katou et al.

(10) Patent No.: US 6,331,004 B1
(45) Date of Patent: Dec. 18, 2001

(54) IMAGE RECORDING DEVICE HAVING A REVERSING SECTION

(75) Inventors: Yasuyuki Katou; Kiyoshi Matsuda, both of Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/177,020

(22) Filed: Oct. 22, 1998

(30) Foreign Application Priority Data

Oct. 24, 1997 (JP) ..... 9-292656

(51) Int. Cl.[7] ..... B65H 39/10; G03G 15/00

(52) U.S. Cl. ..... 271/301; 271/902; 271/302; 399/75; 399/401

(58) Field of Search ..... 399/75, 401; 271/301, 271/902, 302, 9.11

(56) References Cited

U.S. PATENT DOCUMENTS

| | | | | |
|---|---|---|---|---|
| 4,835,567 | | 5/1989 | Ogata . | |
| 4,928,128 | * | 5/1990 | Stemmle | 399/401 |
| 4,966,356 | * | 10/1990 | Ohyabu et al. | 271/9 |
| 5,049,947 | * | 9/1991 | Fish et al. | 271/902 |
| 5,057,874 | | 10/1991 | Miyazaki et al. . | |
| 5,081,508 | * | 1/1992 | Kotani et al. | 355/316 |
| 5,130,759 | * | 7/1992 | Fushimi et al. | 271/291 |
| 5,166,739 | * | 11/1992 | Katsuki et al. | 355/309 |
| 5,191,382 | * | 3/1993 | Okamura et al. | 271/9 |
| 5,240,238 | * | 8/1993 | Lee | 271/9 |
| 5,708,954 | * | 1/1998 | Ando et al. | 399/402 |
| 5,781,823 | * | 7/1998 | Isobe et al. | 399/401 |
| 5,785,308 | * | 7/1998 | Flores et al. | 271/9.11 |
| 5,839,044 | * | 11/1998 | Taruki | 399/401 |
| 5,974,283 | * | 10/1999 | Cho | 399/75 |
| 6,185,381 | * | 2/2001 | Nakahara et al. | 399/21 |
| 6,226,470 | * | 5/2001 | Kohtani et al. | 399/75 |

FOREIGN PATENT DOCUMENTS

| | | | | |
|---|---|---|---|---|
| 62-56229 | * | 3/1987 | (JP) | B65H/1/30 |
| 07-128922 | | 5/1995 | (JP) . | |
| 09-114152 | | 5/1997 | (JP) . | |

* cited by examiner

*Primary Examiner*—Donald P. Walsh
*Assistant Examiner*—Daniel K Schlak
(74) *Attorney, Agent, or Firm*—Akin, Gump, Strauss, Hauer & Feld, L.L.P.

(57) ABSTRACT

In order to provide a reversing section for reversing the recording paper for recording on both sides, in such a manner as to avoid increase in size of the device, reversing rollers 14 are provided over the rear part of the paper cassette 3, and a reversing path 15 is formed at the back of the paper cassette 3. The recording paper 2 having passed the reversing rollers 14 enters the reversing path 15. Additional reversing path 16 is provided under the paper cassette 3, and the recording paper 2 moves from the reversing path 15 into the reversing path 16.

16 Claims, 11 Drawing Sheets

IMAGE RECORDING DEVICE HAVING A REVERSING SECTION

BACKGROUND OF THE INVENTION

The present invention relates to an image recording device such as a printer, or copier, and in particular an image recording device capable of printing on both sides of paper.

With a recording device having a function of recording on both sides of recording paper, it was necessary to provide a reversing section for reversing the recording paper for altering the side of the recording paper facing the image forming section which performs the recording. The reversing section was provided at the back of, or in front of, or over the device, in the prior art.

In the prior art image recording device, a certain space had to be provided for the reversing section, so that the overall size of the device is increased.

SUMMARY OF THE INVENTION

An object of the invention is to provide a recording device which has a function of recording on both sides of recording paper, and yet which is small in size.

An image recording device according to the invention comprises:

- a paper supply section;
- a paper transport path along which recording paper supplied from the paper supply section is transported;
- an image forming section provided on the paper transport path;
- a reversing section for reversing the recording paper;
- wherein
  - said paper supply section has a first end from which the recording paper is picked up, and a second end opposite to said first end,
  - said reversing section comprises:
    - a reversing roller rotating forward and backward, while holding recording paper which is transported from the paper transport path having passed the image forming section, and which is to be reversed, and
    - a reversing path in which the recording paper having passed the reversing roller is reciprocated, and which is formed at least at the second end of the paper supply section,
  - wherein the recording paper reversed by the reversing section is passed over the paper supply section, and guided to the paper transport path.

DETAILED DESCRIPTION OF THE PREFERRED EMBODIMENTS

Embodiments of the present invention will next be described in detail with reference to drawings.

Figure 1:
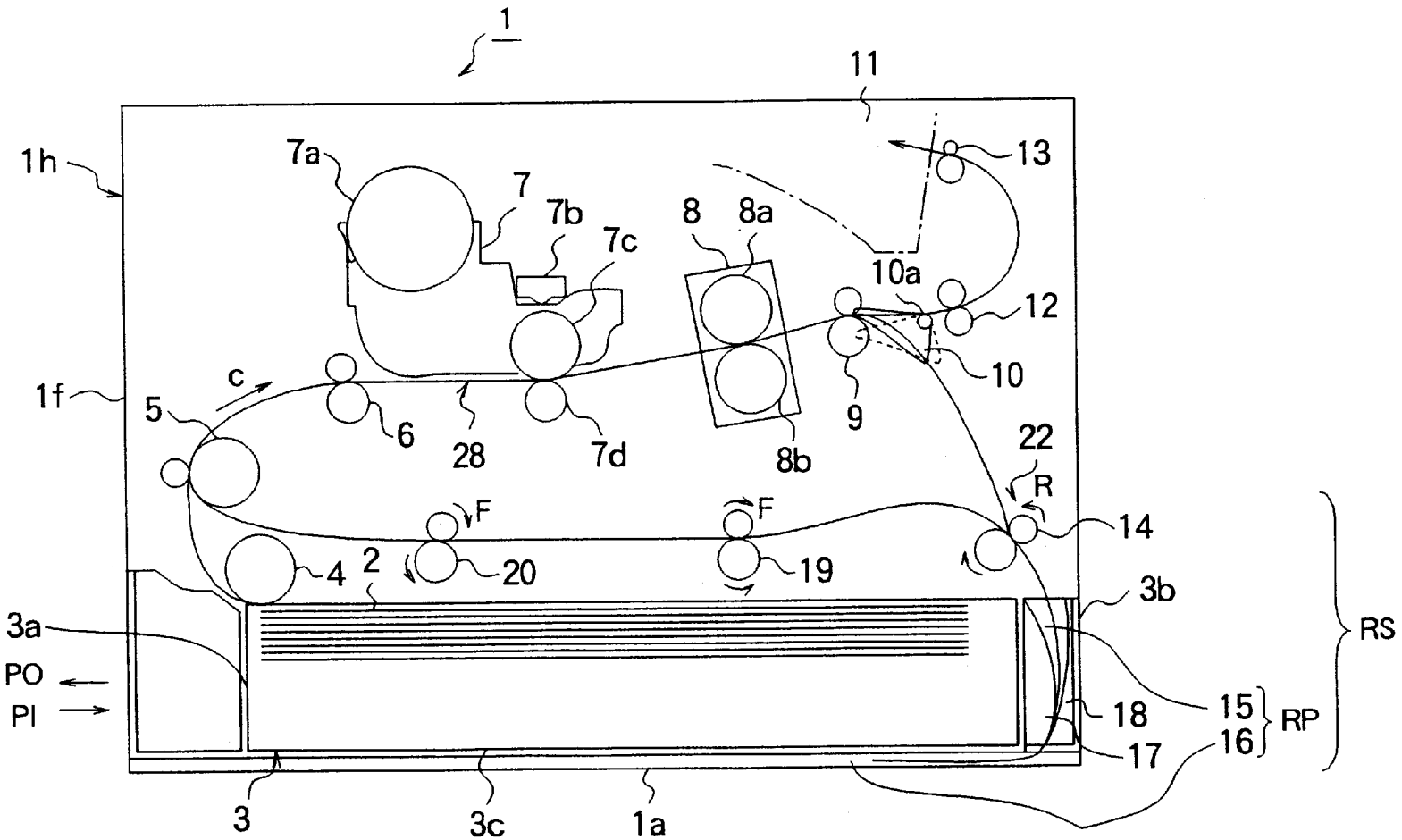
FIG. 1 is a schematic diagram showing the configuration of an image recording device of a first embodiment.

FIG. 1 shows the configuration of an image recording device of a first embodiment of the invention.

Referring to FIG. 1, a paper cassette 3, serving as a paper supply unit forming part of a paper supply section, for accommodating recording paper 2 is removably inserted in an image recording device 1. The paper cassette 3 can be pulled out in the direction of arrow PO, i.e., toward the front or first end 1*f* of the housing 1*h* of the image recording device 1.

A paper pick-up roller 4 is provided above a front or first end 3*a* of the paper cassette 3, and above the leading end of the recording paper 2 in the paper cassette 3. The front end 3*a* of the paper cassette 3 is on the same side as the front end 1*f* of the housing 1*h*.

A pair of transport rollers 5 are rotatably provided over the paper feed roller 4. Another pair of transport rollers 6 are provided downstream (with respect to the direction of paper transport) of the pair of transport rollers 5. An image forming section 7 is provided downstream of the pair of transport rollers 6.

The image forming section 7 includes a toner cartridge 7*a*, a recording head 7*b*, a photosensitive drum 7*c*, and a transfer roller 7*d*, and transfers the toner image corresponding to the recording data, to the recording paper 2 being transported. Provided downstream of the image recording section 7 is a fixing section 8, which fixes the toner image having been transferred to the recording paper 2, by heating and fusing, and is formed of a heating roller 8*a*, and a pressure roller 8*b* pressed against the heating roller 8*a*.

Provided downstream of the fixing section 8 is a gate 10, which is rotatable about an axis 10*a*. The gate 10 is for switching the direction of transport of the recording paper 2, between a path to a discharging section 11, to which the recording paper is to be ejected after completion of recording, and a path to a reversing section RS to which the recording paper is to be directed for being reversed, i.e., turned upside down. Further pairs of transport rollers 12 and 13 are provided between the gate 10 and the discharging section 11.

Provided under the gate 10 is a pair of reversing rollers 14, which are rotatable in forward and backward directions. A reversing path RP comprises a first part 15, and a second part 16. The first part 15 is formed under the pair of reversing rollers 14, and at a rear end 3*b* of the paper cassette 3. The second part 16 is formed between the bottom 3*c* of the paper cassette 3 and the bottom 1*a* of the housing of the device 1.

The first part 15 is defined by guides 17 and 18, which are integral with the paper feed cassette 3. The inner or guiding surfaces of the guides 17 and 18 are curved, to guide the recording paper 2 fed from the reversing rollers 14 smoothly to the horizontally extending second part 16. The second part 16 has a length for accommodating at least one sheet of recording paper 2. The reversing rollers 14, and the reversing path RP in combination form the reversing section RS.

Provided in front (to the left in FIG. 1) of the reversing rollers 14 is a returning path formed of pairs of transport rollers 19 and 20 for transporting the recording paper 2 having been reversed, to the transport rollers 5.

Figure 2:
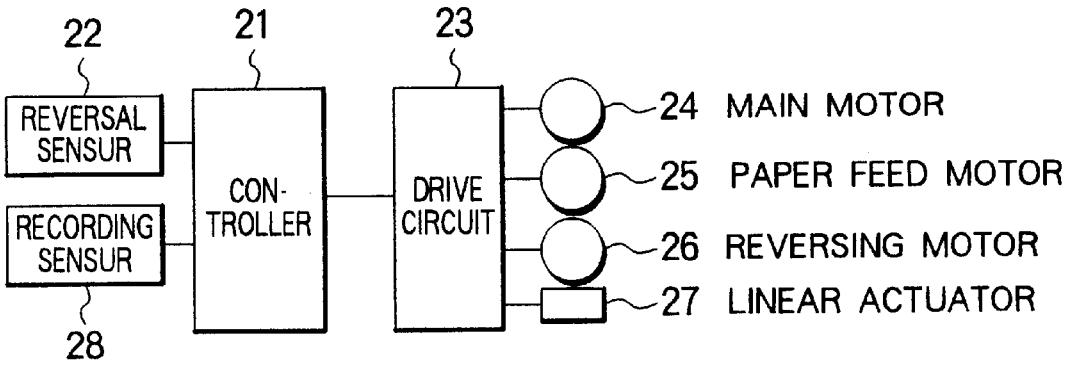
FIG. 2 is a block diagram showing connection between components relating to control over transport of the recording paper in the recording device in the first embodiment.

FIG. 2 is a block diagram showing the connection between components relating to control over transport of the recording paper in the recording device of the first embodiment. A controller 21 controls the operation of the image recording device 1, and is formed of a CPU and the like. The controller 21 is connected to a reversal sensor 22, a recording sensor 28, and a drive circuit 23, and controls them. The reversal sensor 22 is provided upstream of (with respect to the direction of transport) and immediately above the reversing rollers 14, as shown in FIG. 1, and detects the presence or absence of the recording paper 2, and transmits a detection signal to the controller 21. The recording sensor 28 is provided beneath the image forming section 7 and detects the presence or absence of the recording paper 2 passing under the image forming section 7, and transmits a detection signal to the controller 21.

The drive circuit 23 drives a main motor 24, a paper feed motor 25, a reversing motor 26, and a linear actuator 27 including a plunger 27*a* and a solenoid 27*b*. The main motor 24 drives the pairs of transport rollers 5 and 6, the transfer 7*d*, and the pressure roller 8*b*. The paper feed motor 25 drives the pick-up roller 4. The reversing motor 26 drives the reversing rollers 14, and the pairs of transport rollers 19 and 20. The actuator 27 cooperates with a spring, not shown in FIG. 1, to turn the gate 10 about the axis 10*a*.

The operation of the first embodiment will now be described with reference to a flowchart of FIG. 3. It is assumed that recording is made on both sides of a single sheet of recording paper.

Figure 3:
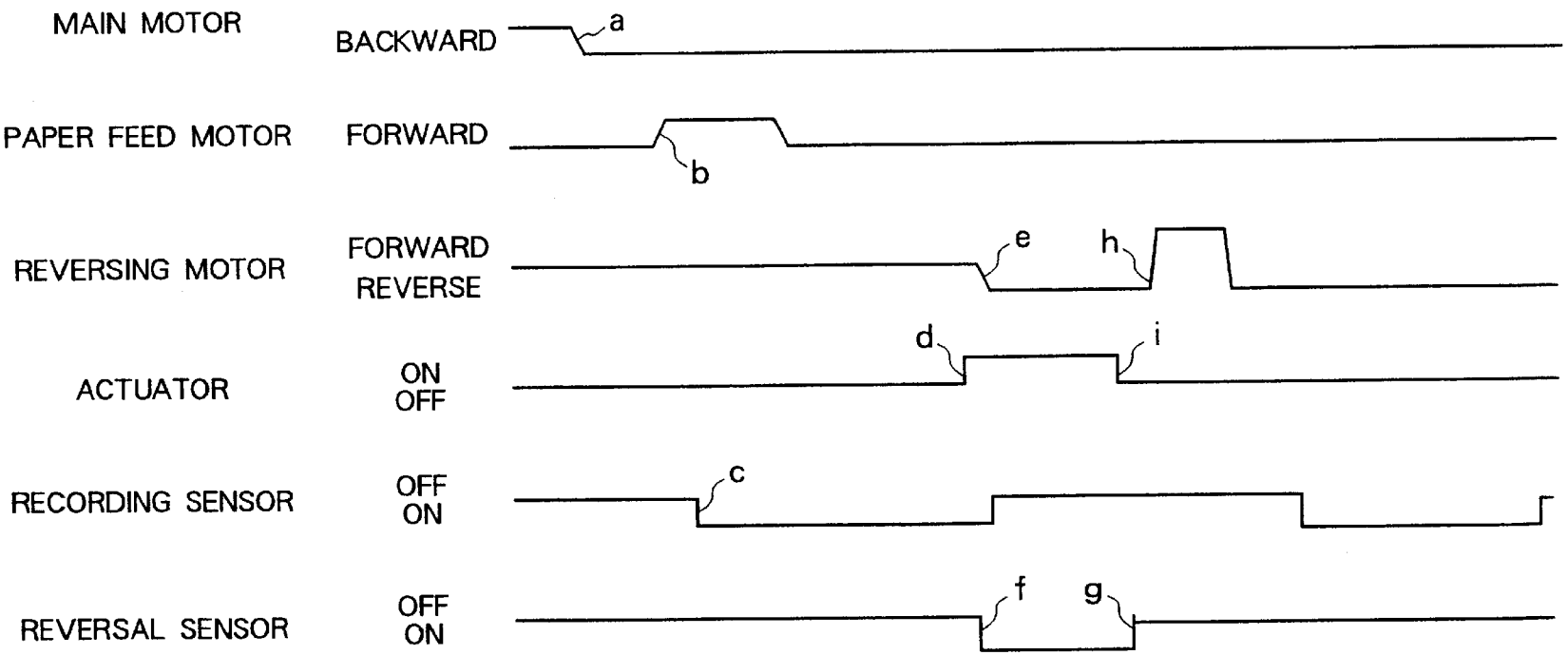
FIG. 3 is a time chart showing the operation of the first embodiment.

When the image recording device 1 receives a recording command from a host computer or some other external device, not shown, the main motor 24 is first made to rotate, so that the pairs of transport rollers 5 and 6, the transfer roller 7*d*, and the pressure roller 8*b* are rotated, as indicated at point a in FIG. 3. Then the paper feed motor 25 is rotated forward to rotate the pick-up roller 4 in the clockwise direction as seen in FIG. 1, as indicated at point b in FIG. 3. The top sheet of recording paper 2 accommodated in the paper cassette 3 is picked up and taken out. The leading end of the recording paper 2 having been taken out enters between the transport rollers 5, and is then transported in the direction of arrow C.

When the leading end of the recording paper 2 passes the recording sensor 28, the detection signal derived from the recording sensor 28 goes active, as indicated at point c in FIG. 3, and the recording paper 2 then enters between the photosensitive drum 7*c* and the transfer roller 7*d*, and the toner image is transferred to the recording paper 2. The recording paper 2 is transported further, and fed to the fixing section 8, where the toner image on the recording paper 2 is fixed by application of heat.

Before the recording paper 2 reaches the transport rollers 9, the actuator 27 is energized, as indicated at point d in FIG. 3. When the actuator 27 is energized, the gate 10 is brought to the position indicated by solid line in FIG. 1. When the actuator 27 is deenergized, the gate 10 is brought the position indicated by broken line in FIG. 1. Because of the energization of the actuator 27, the blade 10 guides the recording paper 2 having passed the transport rollers 9 to the reversing section RS.

Then controller 21 then causes the reversing motor 26 to rotate backward, as indicated at point e in FIG. 3. The reversing rollers 14 are then rotated in the direction of arrow R in FIG. 1. When the leading end of the recording paper 2 passes the reversal sensor 22, the output of the detection sensor 22 goes active, as indicated at point f in FIG. 3. The recording paper 2 enters the reversing rollers 14, and is transported to the first part 15 of the reversing path RP, and is guided by the guides 17 and 18, and then enters the second part 16 of the reversing path RP.

When the tail end of the recording paper 2 passes the reversal sensor 22, the output of the reversal sensor 22 goes inactive, as indicated at point g in FIG. 3. In this way, passage of the front end and the tail end of the recording paper 2 is detected by the reversal sensor 22, and informed to the controller 21. The controller 21 causes the reversing motor 26 to rotate forward upon expiration (point h in FIG. 3) of a certain time interval after the detection of the tail end of the recording paper 2. As a result, the reversing rollers 14 are rotated in the direction opposite to the direction of arrow R in FIG. 1, and the pairs of transport rollers 19 and 20 are rotated in the direction of arrows F in FIG. 1. The recording paper 2 is transported by the reversing rollers 14 and guide elements, not shown, to the transport rollers 19, and moves out of the reversing path RP.

The recording paper 2 is sent by the pairs of transport rollers 19 and 20, to the transport rollers 5, and enters the image forming transport path, formed of the rollers 6, 7*d* and 8*b*, in the state in which it has been turned upside down. That is, the first side of the recording paper on which the toner image has already been transferred is facing downward, i.e., away from the photosensitive drum 7*c*. A toner image is transferred, at the image forming section 7, to the second side of the recording paper 2 having re-entered into the image forming transport path, and is fixed at the fixing section 8. The actuator 27 is deenergized after the recording paper 2 passed the gate 10 upon recording on the first side. That is when the recording paper 2 has passed the recording section second time for printing on the second side, the gate 10 is already in the position indicated by the broken line.

The recording paper 2 having passed the transport rollers 9 is sent to the transport rollers 12, and dicharged to the discharging section 11 by means of the transport rollers 13. In this way, recording on both sides is completed.

As has been described, according to the first embodiment, the reversing path RP for reversing the recording paper 2 is provided at the back of and under the paper cassette 3, so that it is not necessary to provide a separate space for reciprocation of the recording paper, and the recording paper can be reversed, and the size of the device can thus be reduced.

Figure 4:
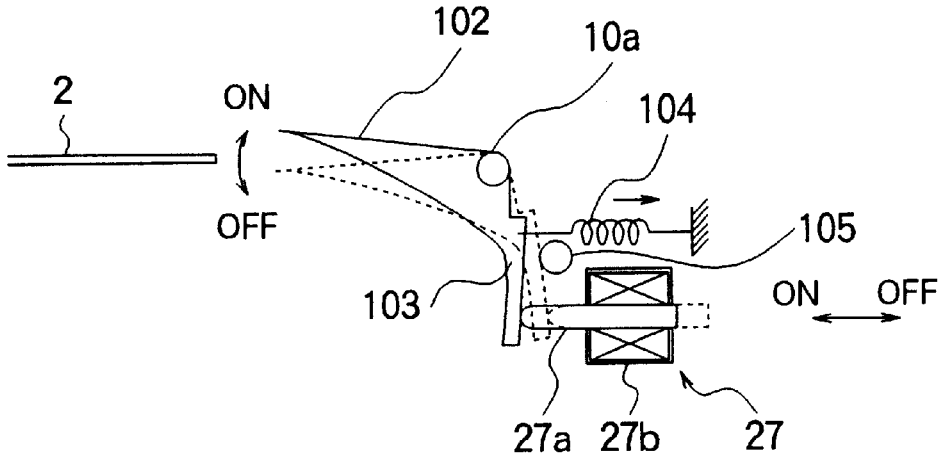
FIG. 4 shows the details of a gate used in the first embodiment.

FIG. 4 shows the details of the gate 10. It has a blade 102 rotatable about the axis 10*a*. A drive arm 103 extends on the opposite side of the blade 102 with respect to the axis 10*a*. A spring 104 is connected to the drive arm 103 to bias the drive arm 103 and the blade 102 in the counterclockwise direction as seen in FIG. 4. The plunger 27*a* of the actuator 27 is engageable with the drive arm 103. When the actuator 27 is not energized, the plunger 27*a* is in the position indicated by the broken line, and the spring 104, serving as a tension spring, pulls the drive arm 103 so that the blade 102 and the drive arm 103 are in the position indicated by the broken line. In order to define this position, a stopper 105 is provided to engage the drive arm 103. When the actuator 27 is energized, the plunger 27*a* is pushed forward, i.e., leftward as seen in FIG. 4, and is brought to the position indicated by the solid line. As a result, the drive arm 103 is pushed forward, or leftward as seen in FIG. 4, and the drive arm 103 and the blade 102 are rotated to the position indicated by the solid line. Thus, the blade 102 can selectively assume one of the two positions. In the position indicated by the broken line, the recording paper 2 fed from the fixing section 8, i.e., from the left side as seen in FIG. 4 is passed over the top surface of the blade 102, and is directed rightward, and led to the transport rollers 12. In the position indicated by the solid line, the recording paper 2 fed from the fixing section 8 is passed beneath the downward surface of the blade 102, and directed downward, and led to the reversing section RS (FIG. 1).

Figure 5:
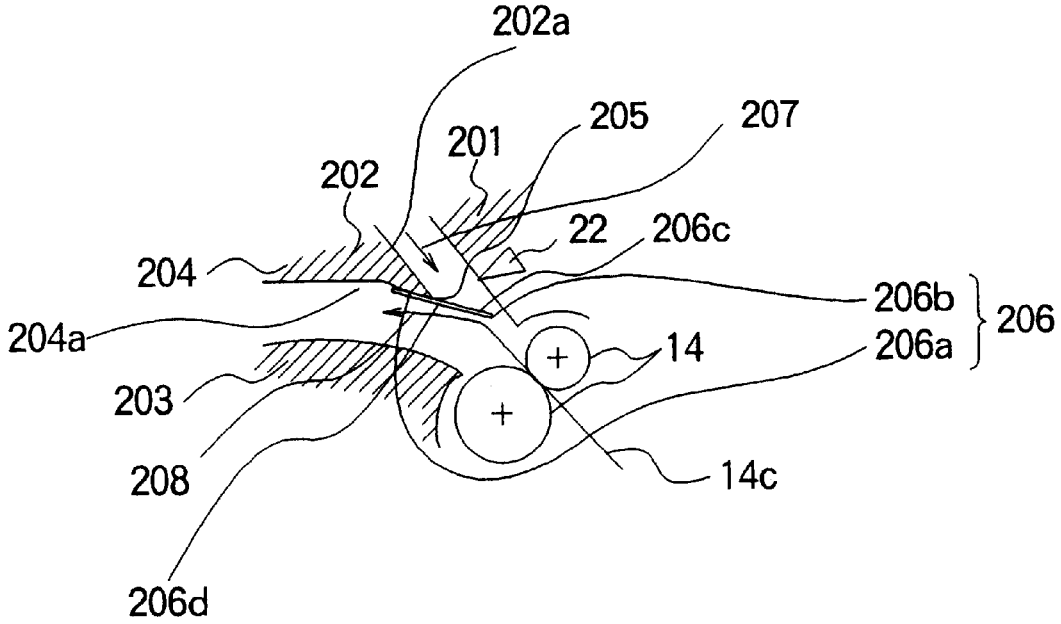
FIG. 5 shows the details of reversing rollers and guides used in the first embodiment.

FIG. 5 shows the details of the guide assembly at the reversing rollers 14. A first pair of guide members 201 and 202 guide the recording paper from the gate 10 to the reversing rollers 14. A second pair of guide members 203 and 204 guide the recording paper 2 from the reversing rollers 14 toward the transport rollers 19 of the returning path. The inner surfaces 202*a* and 204*a* of the guide members 202 and 204 merge, at an edge 205, to form a Y-shaped branch.

A flap 206 made of a resilient sheet material includes a base part 206*a* attached to the inner surface 204*a* of the guide member 204, and a free part 206*b* extending from the edge 205 and toward the reversing rollers 14, and having a first surface 206*c* facing the guide member 201 and a second surface 206*d* facing the guide member 203.

In a free state, the flap 206 is shifted toward the guide member 201, so that the recording paper 2 fed from the gate 10 toward the reversing rollers 14, as indicated by arrow 207, engages with the first surface 206*c* of the free part 206*b* of the flap 206 and pushes aside, resiliently bending the free part 206*b* of the flap 206 toward the guide member 203, to reach the reversing rollers 14, and is then transported to the reversing path RP.

When the recording paper 2 is fed from the reversing path RP to the Y-shaped branch, since the flap 206 is shifted toward the guide member 201, the recording paper 2 engages with the second surface 206*d* of the free part 206*b* of the flap 206, and is guided by the flap 206 to the path formed between the guide members 203 and 204, as indicated by arrow 208, and is led to the transport rollers 19.

In this way, the recording paper 2 transported from the gate 10 to the reversing rollers 14 is first guided to the reversing path RP, and is thereafter transported from the reversing path RP, via the reversing rollers 14, to the transport rollers 19.

Figure 6:
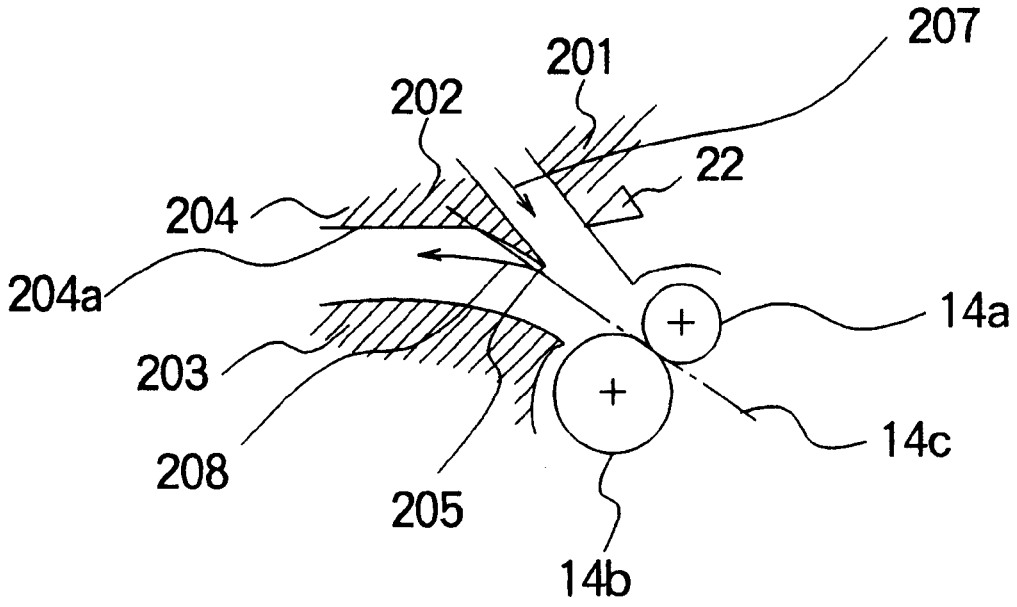
FIG. 6 shows the details of another example of reversing rollers and guides which may be used in place of those shown in FIG. 5.

FIG. 6 shows another example of the guide assembly at the reversing rollers 14. For the description of this example, the reversing rollers are denoted individually by 14*a* and 14*b*. The roller 14*a* is positioned near the guide 201, while the roller 14*b* is positioned near the guide 203.

In this example, the flap used in the example of FIG. 5 is not provided, the edge 205 is offset with respect to the common tangential line 14*c* of the rollers 14*a* and 14*b*, toward the guide member 201, and the common tangential line 14*c* intersects with the inner surface 204*a* of the guide member 204, while the extension of the path formed by the guide members 201 and 202 is so formed that its extension passes near a point at which the rollers 14*a* and 14*b* are in contact with each other. As a result, the recording paper 2 fed from the gate 10, as indicated by arrow 207, is made to pass through the rollers 14*a* and 14*b*.

The recording paper 2 fed from the reversing path RP is guided by the rollers 14*a* and 14*b* and is brought to contact with the inner surface 204*a* of the guide 204, as indicated by arrow 208, and is guided along the path formed between the guides 203 and 204.

Figure 7:
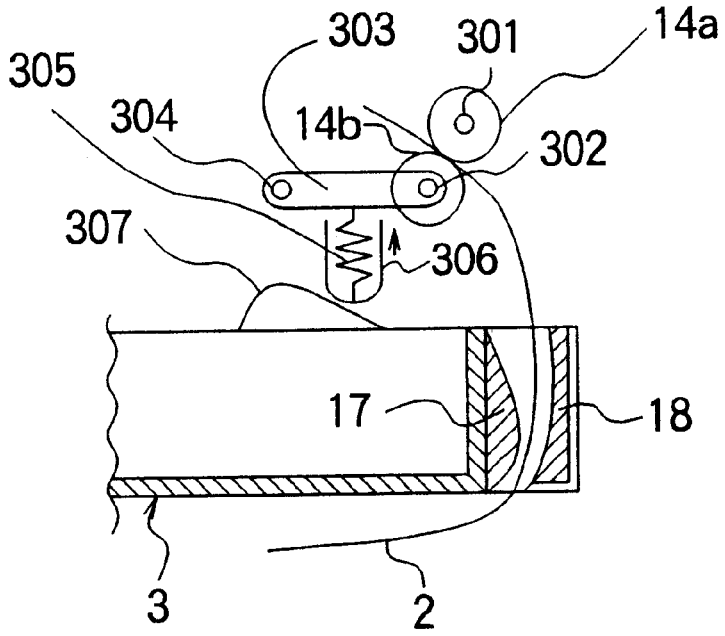
FIG. 7 shows the structure for holding the reversing rollers in the state in which the paper cassette is fully inserted.
Figure 8:
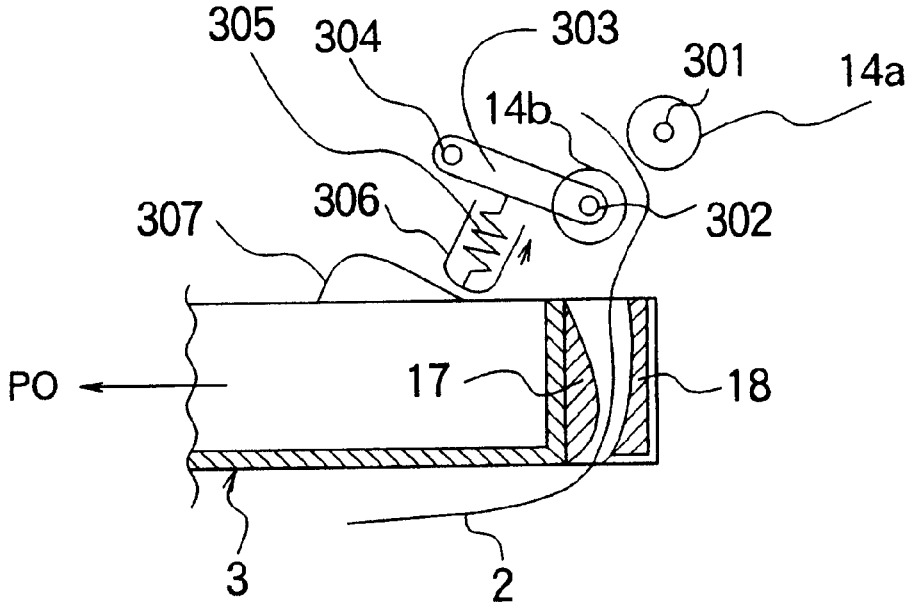
FIG. 8 shows the structure for holding the reversing rollers in the state in which the paper cassette is removed from the fully-inserted position.

FIG. 7 and FIG. 8 show an example of the structure for holding the reversing rollers 14*a* and 14*b*. A first roller 14*a* is rotatably supported by a pin 301 to the frame of the device, not illustrated. A second roller 14*b* is rotatably supported by a pin 302 fixed to an arm 303 which is pivotably supported by a pin 304 to the frame of the device. A compression spring 305 is attached to the arm 303, and extends downward. A cap 306 is attached to and covers the lower end of the spring 305. A protrusion 307 is provided on the paper cassette 3. FIG. 7 shows the state when the paper cassette 3 is inserted, or, more strictly, in a fully-inserted position in a position allowing picking-up of the paper, while FIG. 8 shows the state when the paper cassette 3 is removed from the fully-inserted position.

When the paper cassette 3 is fully inserted, the protrusion 307 engages the cap 306, and pushes the spring 305 upward. As a result, the arm 303 is rotated counterclockwise as seen in FIG. 7, and the roller 14*b* is pressed against the roller 14*a*. The recording paper 2 passing between the rollers 14*a* and 14*b* are therefore held between the rollers 14*a* and 14*b*.

As shown in FIG. 8, when the paper cassette 3 is removed, being moved leftward, the protrusion 307 is disengaged or separated from the cap 306, and the spring 305 moves down. The arm 303 therefore is rotated clockwise as seen in FIG. 8, and the roller 14*b* is separated from the roller 14*a*.

If jamming of the recording paper 2 occurs at the back of the paper cassette 3, being pinched between the rollers 14*a* and 14*b*, the paper cassette 3 is removed, as shown in FIG. 8. Then, the recording paper 2 is released from the rollers 14*a* and 14*b*. As the cassette 3 is moved away from the fully-inserted position (moved leftward in FIG. 8), the recording paper 2 is also pulled because part of the recording paper 2 is held between the guide members 17 and 18 forming the first part 15 of the reversing path RP at the back of the paper cassette 3. Another part of the recording paper 2 may be in the second part 16 of the reversing path RP which is between the bottom 3*c* of the paper cassette 3 and the bottom 1*a* of the housing 1*h* of the device, but this part is also removed, as the part of the recording paper 2 in the first part 15 is pulled outward. The entire recording paper 2 can therefore be moved out smoothly.

Second Embodiment

Figure 9:
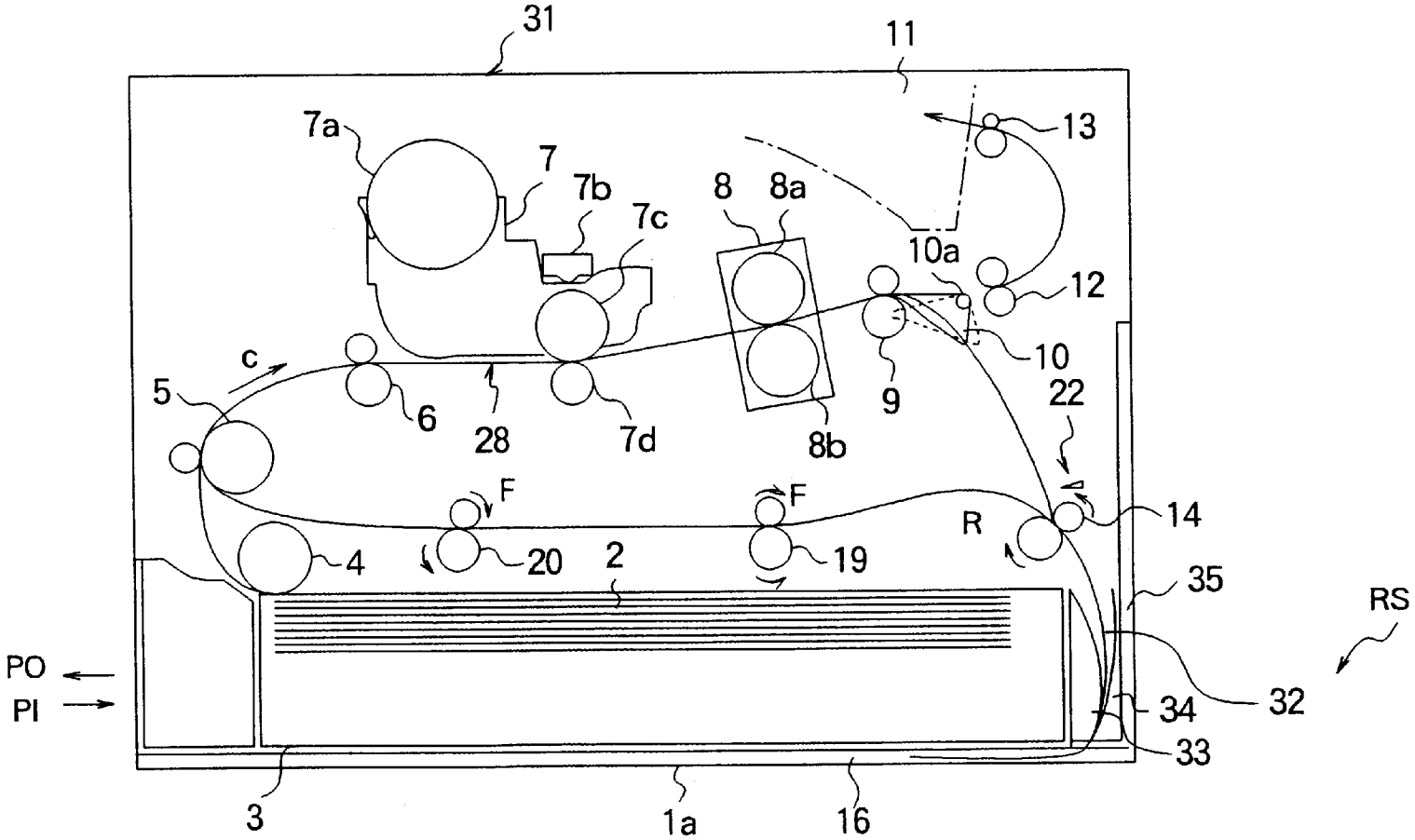
FIG. 9 is a schematic diagram showing the configuration of an image recording device of a second embodiment.

FIG. 9 shows the configuration of the image recording device of a second embodiment.

Referring to FIG. 9, in the image recording device 31 of the second embodiment, the reversing path RP has a first part 32 provided at the back of the paper cassette 3. That is, the first part 32 of the reversing path RP is formed of a guide 33 and the guide 34. The guide 33 is integral with the paper cassette 3, while the guide 34 is integral with the rear cover 35 of the device 31. That is, the guides 33 and 34 are integral with different members of the device, so that they can be separated. The second part 16 of the reversing path RP is formed under the paper cassette 3, as in the first embodiment. The rest of the configuration is identical to that of the first embodiment. The operation is also identical to that of the first embodiment.

In the second embodiment configured as described above, the effects similar to those of the first embodiment are obtained. In addition, when jamming of the recording paper 2 occurs at or near the first part 32 of the reversing path RP, when the paper cassette 3 is pulled out in the direction of arrow PO, the guide 33 is separated from the guide 34, and the recording paper 2 is left there. The recording paper 2 can therefore be removed without being damaged.

Third Embodiment

Figure 10A:
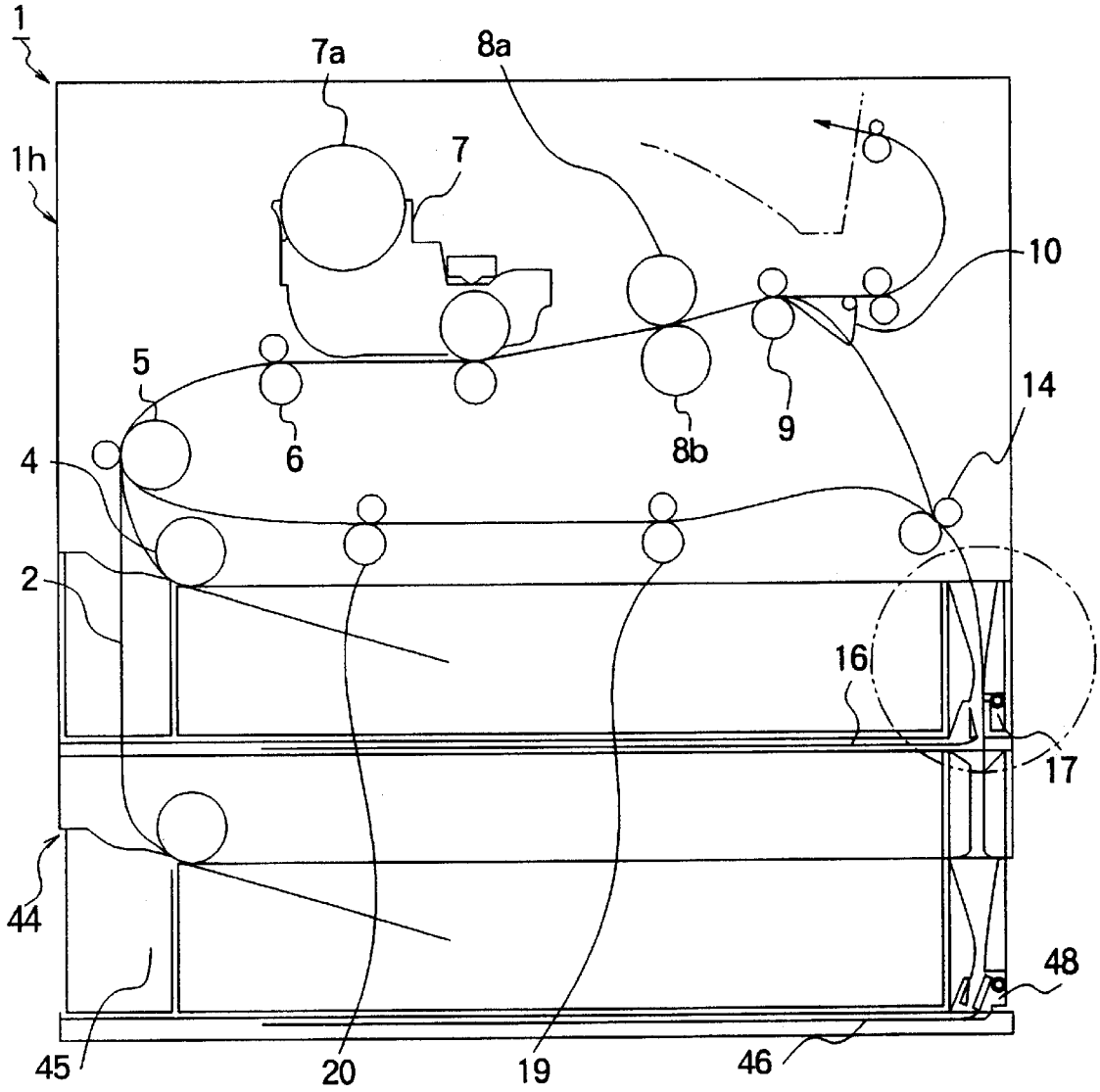
FIG. 10A is a schematic view of the configuration of image recording device of a third embodiment.
Figure 10B:
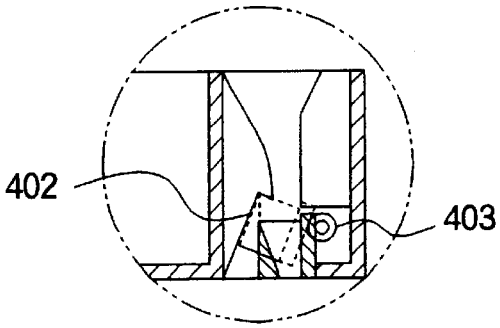
FIG. 10B is a partial sectional view showing a gate member in FIG. 10A in an enlarged scale.

FIG. 10A and FIG. 10B show a third embodiment of the recording device. This embodiment is similar to the first embodiment, but an additional, or second paper supply unit 44 is provided below the paper cassette 3 which serves as a first paper supply unit. The first and second paper supply units in combination form a paper supply section of this embodiment. The paper cassette 3 can be removed and inserted in the state in which the second paper supply unit 44, in the form of a tray, is mounted to the frame of the device. When the second paper supply unit 44 is mounted, and the first paper supply unit 3 is inserted, the back end of the second paper supply unit 44 is in alignment with the back end of the first paper supply unit 3.

In the state in which the paper cassette 3 and the second paper supply unit 44 are mounted, the reversing path RP is formed to extend through the back of the paper cassette 3, and the back of the second paper supply unit 44, and then under the second paper supply unit 44.

When the second paper supply unit 44 is not mounted, the reversing path RP is formed through the back of the paper cassette 3, and under the paper cassette 3, as in the first embodiment.

The alteration of the reversing path is achieved by a gate member 17 provided at the bottom of the part of the reversing path at the back of the paper cassette 3, and an engaging member 401 (FIG. 11A, FIG. 11B) cooperating with the gate member 17. The gate member 17 is shown in an enlarged scale in FIG. 10B, and is shown in schematic perspective view in FIG. 11A and FIG. 11B.

More specifically, the gate member 17 comprises a movable guide 402 fixed to and supported by a pair of supporting brackets 403 (only one of which is shown while the other bracket at the opposite end is not shown) provided on both ends of the movable guide 402. A pair of pins 404 (only one being shown) which are in alignment with each other are attached to the respective brackets 403. The pins 404 are rotatably supported by the side walls 405 of the paper cassette 3.

The movable guide 402 is attached to one side of the each bracket 403, while a projection 406 extends sideways from the other side of each bracket 403. The projection 406 at each end of the movable guide 402 extends through a cut-away 407 in the side wall 405 adjacent to the corresponding end of the movable guide 402.

The engagement member 401 is fixed to the second paper feed unit 44 and has inwardly-extending projection 408 engageable with the projection 406, when the paper cassette 3 is inserted.

Figure 11A:
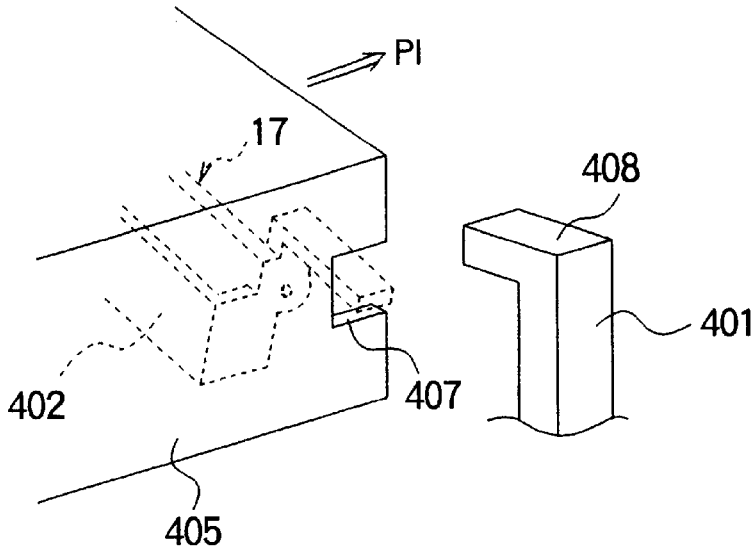
FIG. 11A and FIG. 11B show details of the gate member used in the third embodiment, as well as in a fourth and fifth embodiments.
Figure 11B:
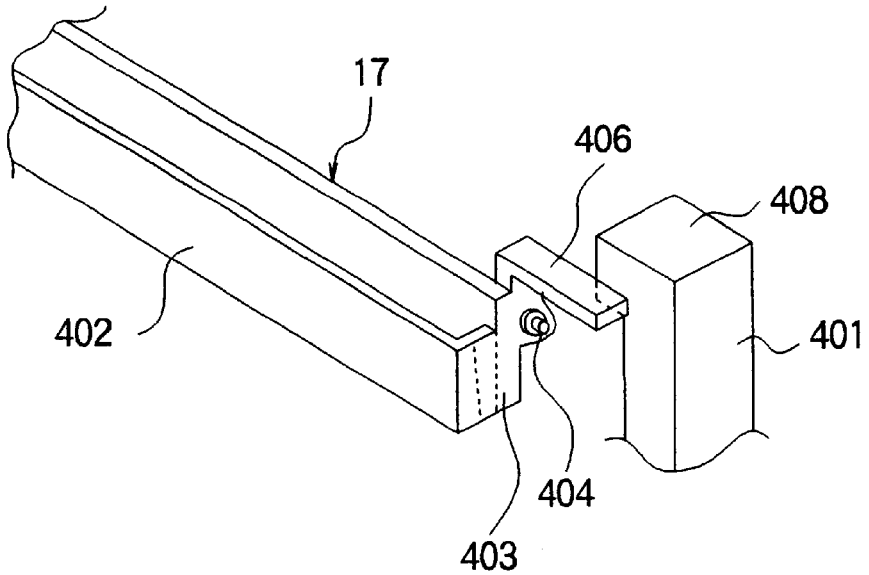

When the second paper supply unit 44 is mounted, and the paper cassette 3 is fully inserted, the projections 406 and 408 engage with each other, and the bracket 403 is rotated counterclockwise as seen in FIG. 11B, and the movable guide 403 is upright as seen in FIG. 11B. In this state, the paper fed from above is guided downward. That is, the paper having passed the back of the paper cassette 3 is led to the back of the second paper supply unit 44, and then under the second paper supply unit 44. In this condition, most part of the paper is in the path extending vertically and in alignment with each other. Accordingly, the curling of the paper is reduced. The curling is a problem particularly when conducting the printing on the second side of the paper. By reducing the curling, the paper can be transported more smoothly, and the possibility of jamming is reduced.

When the projection 406 is not in engagement with the projection 408, the movable guide 402 is inclined as shown in FIG. 11A. This is the case, when the paper cassette 3 is not fully inserted in the device, or when the paper cassette 3 is inserted but the second paper supply unit 44 is not mounted. When the movable guide is inclined the lower end is shifted forward as seen in FIG. 11A, and the recording paper 2 having passed the back of the paper cassette 3 is guide to the path under the paper cassette 3. This is similar to the first embodiment.

Fourth Embodiment

Figure 12:
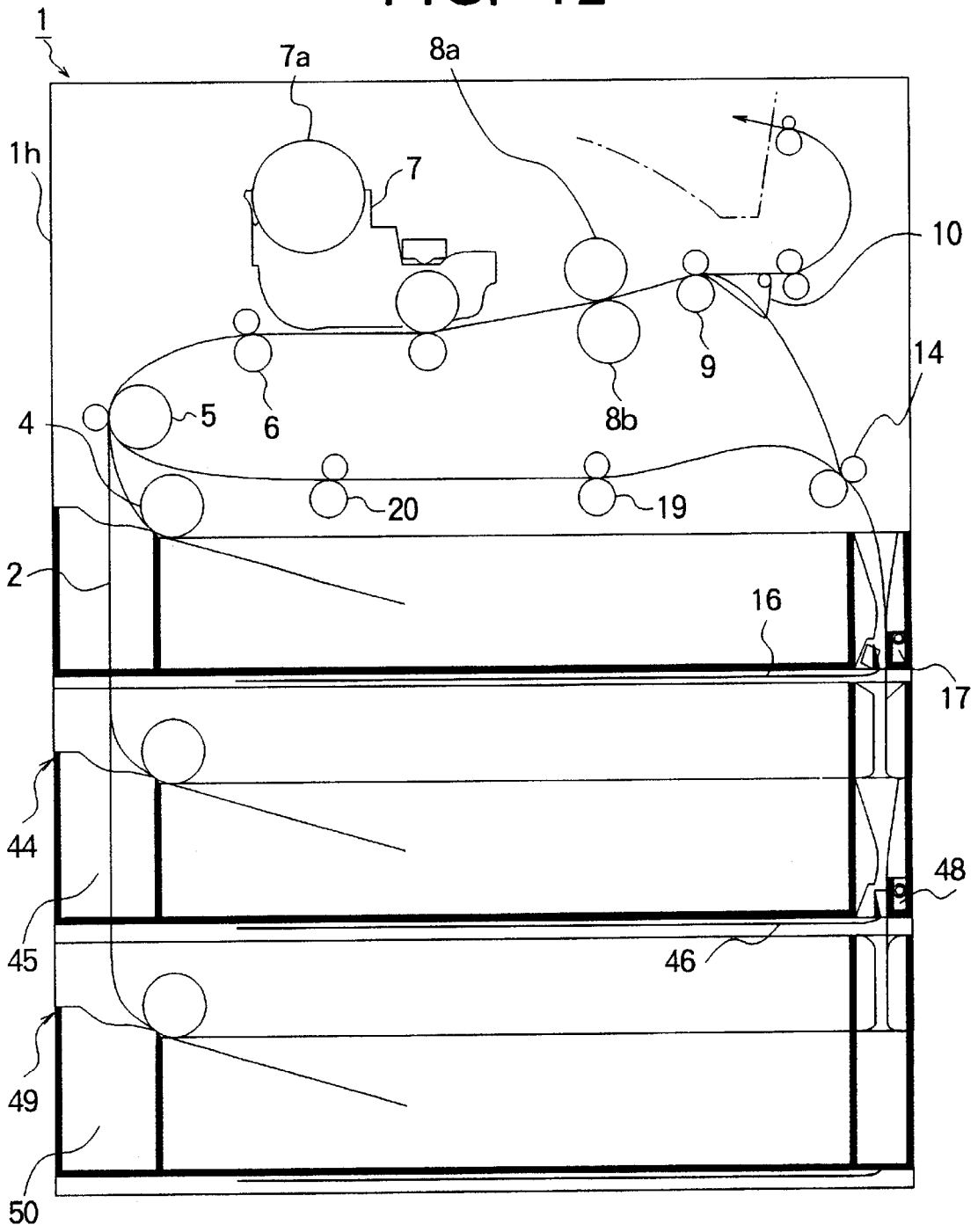
FIG. 12 is a schematic view of the configuration of image recording device of the fourth embodiment.

FIG. 12 shows a fourth embodiment of the invention. This embodiment is similar to the third embodiment, but another tray, or a third paper supply unit 49 is provided beneath the second paper supply unit 44. When the second and third paper supply units 44 and 49 are mounted, and the first paper supply unit 3 is inserted, the back ends of the second and third paper supply units 44 and 49 are in alignment with the back end of the first paper supply unit 3.

Provided at the bottom of the reversing path part at the back of the second paper supply unit 44 is a gate member 48 which is similar to the gate member 17 at the bottom of the reversing path part at the back of the second paper supply unit 44. The gate member 48 has the configuration identical to the gate member 17, but the pins 404 are supported by the side walls of the second paper supply unit 44, each projection 407 projects through a cut-away in the adjacent side wall of the second paper supply unit 44 and the projection 401 is fixed to the third paper supply unit 49.

A further reversing path part is formed under the third paper supply unit 49.

Because the reversing path is also formed at the back of the third paper supply unit 49, the total length of the vertically extending reversing path part is increased, and the curling is further reduced.

The concept described above in connection with the third and fourth embodiments can be similarly applied when the number of additional paper supply units are more than three.

Fifth Embodiment

Figure 13:
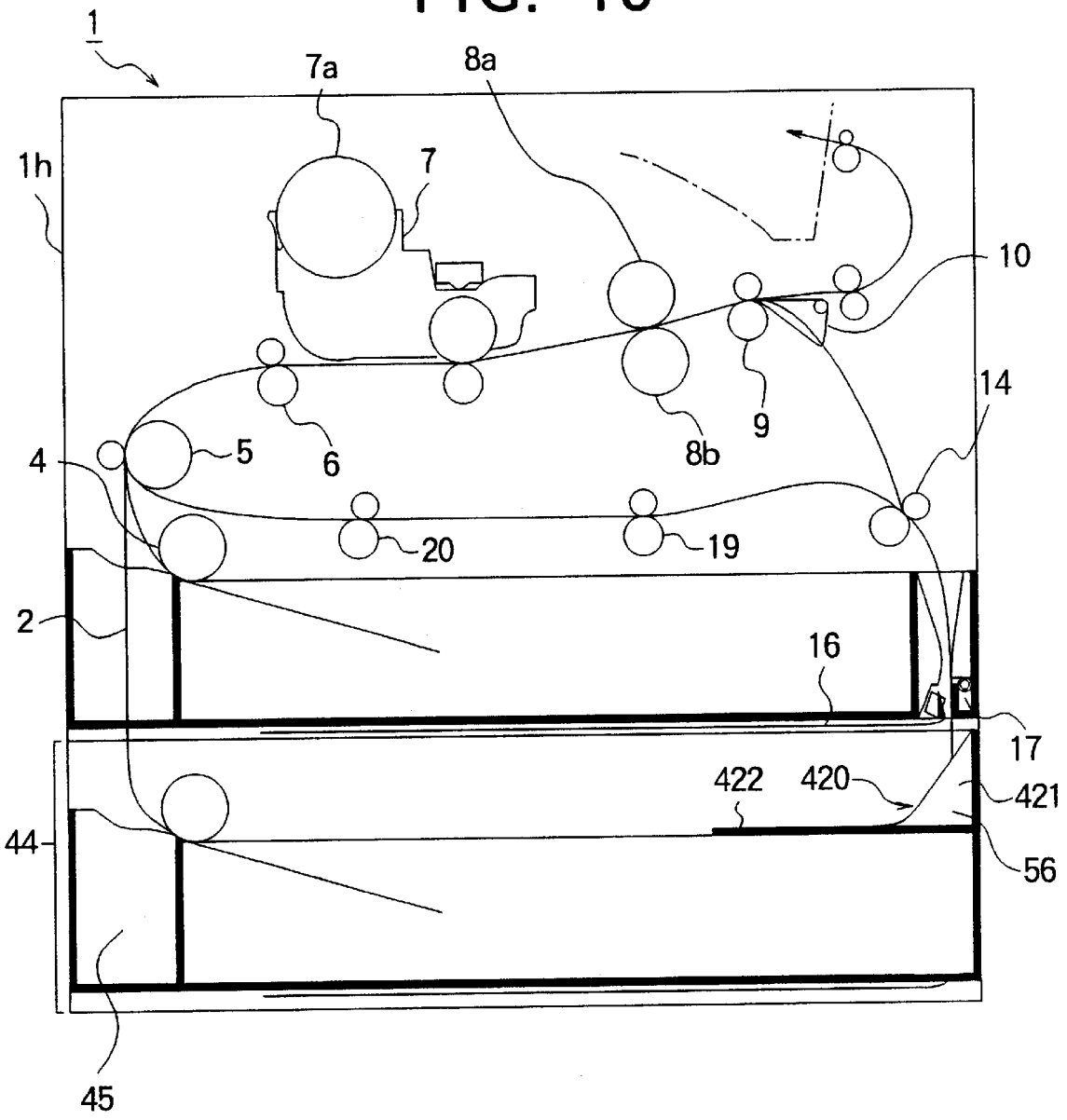
FIG. 13 is a schematic view of the configuration of image recording device of the fifth embodiment.

FIG. 13 shows a fifth embodiment of the invention. This embodiment is similar to the third embodiment. But the reversing path part 46 at the bottom of the second paper supply unit 44 is not provided, and the reversing path part at the back of the second paper supply unit 44 (and outside of the space in which the paper is contained) is not provided. Instead, a reversing path part 56 is formed within the second paper supply unit 44, and above the recording paper 2 stacked therein. A guide 420 is provided within the space in which the recording paper 2 is contained. The guide 420 includes a curved part 421 and a horizontally extending part 422. The recording paper 2 having passed the gate member 17 is brought into contact with this guide part 421, and guided along the curved part 421 of a smaller curvature, and then along the horizontally extending part 422. Because the guide part 421 is of a curve of a smaller curvature, resistance to the paper transport required is smaller. The possibility of jamming is therefore reduced. In addition, the curling is also reduced because the curve is of a smaller curvature, and the force applied to the paper for the purpose of transport is also reduced.

As has been described, according to the invention, the reversing path for reversing the recording paper is formed at least partly on the side of the paper supply section, opposite to the paper pick-up section. Accordingly, the reversing path can be formed with a minimum space.

What is claimed is:

1. An image recording device comprising:

a paper supply section;

a paper transport path along which recording paper supplied from the paper supply section is transported;

an image forming section provided on the paper transport path;

a reversing section for reversing the recording paper, wherein said paper supply section includes a paper cassette which has a first end from which the recording paper is picked up, and a second end opposite to said first end, said reversing section comprising:

a pair of reversing rollers rotating forward and backward, while holding recording paper which is transported from the paper transport path having passed the image forming section, and which is to be reversed, a reversing path in which the recording paper having passed the reversing rollers is reciprocated, and which is formed at least at the second end of the paper supply section, and a returning path formed over the paper supply section for transporting the recording paper to the paper transport path, the recording paper having been reversed, said reversing path including a first guide which is integral with the paper cassette, wherein the recording paper reversed by the reversing section is passed through said returning path, and guided to the paper transport path.

2. The image recording device according to claim 1, wherein said reversing path further includes a second guide which is also integral with the paper cassette, said first and second guides having guiding surfaces between which said recording paper is guided.

3. The image recording device according to claim 2, wherein the gap between the guiding surfaces of the first and second guides is gradually narrowed.

4. The image recording device according to claim 2, further comprising a housing, wherein said reversing rollers include first and second rollers, the second roller being separated when the paper supply cassette is removed from the housing.

5. The imaging recording device according to claim 2, wherein the reversing rollers are provided over the first and second guides.

6. The image recording device according to claim 1, further comprising a rear cover, wherein said reversing path further includes a second guide which is integral with the rear cover of the device, said first and second guides having guiding surfaces between which said recording paper is guided.

7. The image recording device according to claim 6, wherein the gap between the guiding surfaces of the first and second guides is gradually narrowed.

8. The imaging recording device according to claim 6, wherein the reversing rollers are provided over the first and second guides.

9. The image recording device according to claim 1, wherein said reverse path also includes a part which is under the paper supply unit.

10. The image recording device according to claim 1, wherein said device comprises a housing, said paper supply section further comprising one or more paper trays positioned under the paper cassette and positioned one over another, and said reversing path being formed at second ends of the respective paper trays, said second ends of the paper trays being aligned with the second end of the paper cassette.

11. The image recording device according to claim 10, wherein said one or more paper trays includes at least a first paper tray and a second paper tray which can be mounted under said first paper tray, said device further comprising a gate provided at said second end of the first paper tray, for leading the recording paper to the reversing path formed by said second paper tray, or to the reversing path between the bottom of the first paper tray and the bottom of the housing, depending on whether the second paper tray is mounted under the first paper tray.

12. The image recording device according to claim 1, further comprising a housing, said paper supply section comprising a paper cassette which is removably inserted from a first end of the housing of the device, said first end of the housing being on the same side as the first end of the paper supply section, wherein said reversing path is also formed under said paper cassette, said paper supply section also comprising a first paper tray which can be mounted under the paper cassette, said reversing path being formed by said first paper tray, and said device further comprising a gate provided at said second end of the paper cassette, for leading the recording paper to the reversing path formed by said first paper tray or the reversing path formed between the bottom of the paper cassette and the bottom of the housing, depending on whether the first paper tray is mounted under the paper cassette.

13. An image recording device comprising:

a paper supply section;

a paper transport path along which recording paper supplied from the paper supply section is transported;

an image forming section provided on the paper transport path; and a reversing section for reversing the recording paper; wherein said paper supply section has a first end from which the recording paper is picked up, and a second end opposite to said first end, said reversing section comprising:

a reversing roller rotating forward and backward, while holding recording paper which is transported from the paper transport path having passed the image forming section, and which is to be reversed, and a reversing path in which the recording paper having passed the reversing roller is reciprocated, and which is formed at least at the second end of the paper supply section, wherein the recording paper reversed by the reversing section is passed over the paper supply section, and guided to the paper transport path, wherein said device comprises a housing, said paper supply section comprises a paper cassette which is removably inserted from the housing of the device, said reversing path being formed under said paper cassette, said paper supply section also comprising a first paper tray which can be mounted under the paper cassette, and said reversing path being formed by said first paper tray, said device further comprising a gate provided at said second end of the paper cassette, and means for switching said gate between a first position in which the recording paper is led to the reversing path formed by said first paper tray and a second position in which the recording paper is led to the reversing path formed between the bottom of the paper cassette and the bottom of the housing, depending on whether the first paper tray is mounted under the paper cassette.

14. An image recording device comprising:

a paper supply section;

a paper transport path along which recording paper supplied from the paper supply section is transported;

an image forming section provided on the paper transport path;

a reversing section for reversing the recording paper; wherein said paper supply section has a first end from which the recording paper is picked up, and a second end opposite to said first end, said reversing section comprising:

a reversing roller rotating forward and backward, while holding recording paper which is transported from the paper transport path having passed the image forming section, and which is to be reversed, and a reversing path in which the recording paper having passed the reversing roller is reciprocated, and which is formed at least at the second end of the paper supply section, wherein the recording paper reversed by the reversing section is passed over the paper supply section, and guided to the paper transport path, wherein said device comprises a housing, said paper supply section comprising a paper cassette which is removably inserted from the housing of the device, said reversing path being formed under said paper cassette, wherein said paper supply section also comprises a first paper tray positioned under the paper cassette, and said reversing path is also formed by said first paper tray and wherein said reversing path formed by said first paper tray is formed in the space within the first tray and above the recording paper stacked in said first paper tray, and toward said second end of said paper supply section whereby the recording paper having passed the reversing path at said second end of the paper supply section is guided into said reversing path formed by said first paper tray via one of its end at said second end of paper supply section.

15. The image recording device according to claim 13, wherein said switching means causes the gate to be in said first position when said first paper tray is mounted, and to be in said second position when said first paper tray is not mounted.

16. The image recording device according to claim 13, further comprising a first engaging member fixed to said first paper tray, and a second engaging member fixed to said gate, wherein the gate is moved to said first position when said first and second engaging members engage with each other.

* * * * *